US005125158A

United States Patent [19]

Casebolt et al.

[11] Patent Number: 5,125,158

[45] Date of Patent: Jun. 30, 1992

[54] HAND MANIPULATED PORTABLE CUTTING AND SHEARING TOOL WITH SPREADER ADAPTORS

[76] Inventors: David R. Casebolt, 1495 S. Gage St., San Bernardino, Calif. 92408; Tommy L. Patton, 2048 Arrow Hwy., La Verne, Calif. 91750

[21] Appl. No.: 314,614

[22] Filed: Feb. 23, 1989

[51] Int. Cl.[5] ..... B26B 15/00

[52] U.S. Cl. ..... 30/228; 30/241

[58] Field of Search ..... 30/228, 241, 227.4, 30/292, 242, 243, 182, 180

[56] References Cited

U.S. PATENT DOCUMENTS

| | | | |
|---|---|---|---|
| 1,114,649 | 10/1914 | Reed . | |
| 2,539,124 | 1/1951 | Findlay . | |
| 2,711,583 | 6/1955 | Raby | 30/228 |
| 2,765,036 | 10/1956 | Harper . | |
| 3,635,107 | 1/1972 | Schmidt . | |
| 3,807,046 | 4/1974 | Igyarto et al. . | |
| 3,819,153 | 6/1974 | Hurst . | |
| 3,884,100 | 5/1975 | Fideldy . | |
| 4,198,748 | 4/1980 | Lewis | 30/241 X |
| 4,318,316 | 3/1982 | Guilliams . | |
| 4,412,380 | 11/1983 | Kish . | |
| 4,434,555 | 3/1984 | Stoll . | |
| 4,549,349 | 10/1985 | Harrison . | |
| 4,608,754 | 9/1986 | Kloster . | |

*Primary Examiner*—Douglas D. Watts
*Attorney, Agent, or Firm*—Jessup, Beecher & Slehofer

[57] ABSTRACT

A cutting tool for severing a workpiece includes a main frame having a horizontal rail member and a grooved channel running its longitudinal length. There is an upright rigid head formed at one end of the frame which can either be a straight, a C-shaped or a pincer-like type of upright member. The upright head has a slot. The blade can reciprocate along the grooved channel and enter the head so that the blade can fully sever a workpiece placed in the gap between the blade and head. The cutting blade can either be V-shaped or concave shaped. The base of the cutting blade has a flange cooperating with the grooved channel for guiding the blade. The cutting blade is manipulated by a hydraulic piston which is mounted to the rear of the frame. The fluid pressure causes a shaft to extend or retract with the cutting blade attached to it. Additional features of the basic invention include handles for allowing the operator to manipulate the tool and accessories such as a portable hydraulic pump which is powered by a battery operated DC electric motor or an AC electric motor or a small gasoline driven piston engine to turn the hydraulic pump to supply hydraulic fluid under pressure to the cutting tool. There is a spreader adaptor for attachment to the tool to allow the tool to spread apart pieces of metal. There is also a clamping pliers to keep the workpiece from deforming while being cut.

10 Claims, 5 Drawing Sheets

16
18
86
38
92
94
80
90
88
82
84

16
18
130
108
38
20
112
128
120
110
111
118
106
116
115
105
114
103
102
104
100
124
122

HAND MANIPULATED PORTABLE CUTTING AND SHEARING TOOL WITH SPREADER ADAPTORS

BACKGROUND OF THE INVENTION

1. Field of the Invention

Cutlery. Pipe and rod cutters adapted to cut pipe or rod transversely; cutting tool with a blade guide; cutting tool with material receiving opening; cutting tool with blade moving means; cutting tool with one moveable blade and slot; cutting tool with blade moving means; cutting tool having a detachable blade. Cutting tool with adjunct clamp-on locking pliers.

Spreader adaptor attachment for a cutter.

Tool jaws positioned by relatively movable plural handles; including toggle means; semicircular jaw features.

Hydraulic rescue equipment.

2. Description of the Prior Art

At the present time, exhaust systems that are replaced at muffler shops, are removed by cutting with a powered circular saw, manually with a hack saw, or severed with a hammer and cold chisel. An arc welder or an acetylene torch are also frequently employed to remove the damaged section, and the replacement section is then welded in place.

U.S. Pat. No. 4,608,754 issued to Kloster discloses a power driven exhaust pipe cutter, which is pneumatically powered.

U.S. Pat. No. 3,807,046 issued to Igyarto et al. discloses a tube cutter for cutting relatively soft tubing, such as plastic tubing and rubber hose. The cutter has a cutting knife and is hand squeezed to cut the section of the workpiece positioned in the cutter's jaws.

U.S. Pat. No. 3,635,107 issued to Schmidt discloses a vice-grip toggle-type hand tool.

U.S. Pat. No. 2,539,124 issued to Findley discloses a tube cutting device which cuts the metal walls of a piece of tubing by a shearing action while preventing the collapsing or deformation of the walls of the tubing adjacent to the cut.

U.S. Pat. No. 4,412,380 issued to Kish discloses a manually-operable handle having a removable cutting blade for cutting pieces of air conditioning hoses.

U.S. Pat. No. 1,114,649 issued to Reed discloses a pipe wrench having opposed semicircular jaws for gripping the pipe.

SUMMARY AND OPERATION OF THE INVENTION

A cutting tool for severing the cross section of an automobile exhaust pipe or for severing portions of the body of an automobile includes a main frame having a horizontal rail member and grooved channel running along its entire longitudinal length. There is an upright rigid head formed at one end of the frame which can either be an upright, a C-shaped or a pincerlike type of upright member. The upright head has a slot and grooved channel so that a cutting blade can be reciprocate along the grooved channel can pass into and through the upright rigid head so that the cutting edge of the cutting blade can fully sever a workpiece which is placed in the gap between the movable blade, the rigid head, and the rail member. The cutting blade can either be a V-shaped having a bibeveled cutting surface, a V-shaped having a single bevelled cutting surface, or a concave arcuate shaped single bevelled cutting surface. The base of the cutting blade has an inverted T-shaped flange so that the cutting blade can travel back and forth along the grooved channel of the frame to keep the cutting blade in alignment when in operation so that it will traverse the path of the grooved channel. The cutting blade is manipulated by a hydraulic piston which is rigidly mounted to the rear of the frame. The piston is hydraulically actuated by a pair of hydraulic lines attached to the back of the piston. By means of a control switch, the fluid pressure will enter the hydraulic piston causing the cutting blade to move toward the rigid upright head thereby severing the workpiece placed in its path. Additional features of the basic invention include handles for allowing the operator to manipulate the tool and accessories such as a portable hydraulic pump which is powered by a battery operated DC electric motor or an AC electric motor or a small gasoline driven piston engine to turn the hydraulic pump to supply hydraulic fluid under pressure to the cutting tool.

The present invention can be used in an automobile dismantling operation, at a muffler repair shop, or used as an emergency rescue tool to extricate accident victims who are trapped in a damaged vehicle, such as an automobile or an airplane.

The invention is essentially a rigid frame formed by a horizontal rail member having an upright rigid head at one end. The frame is usually fabricated as a single piece by a die cast process. There is a blade guide formed by an open recess running the length of the rail member, and the rigid head has a slotted opening for allowing the cutting blade to pass through. There is an hydraulic piston bolted to the end of the frame opposite the rigid head. The hydraulic piston has an extensible and retractable shaft and a cutting blade attached to it so that the cutting blade can slide in the blade guide of the rail member while forced by the hydraulic shaft, hydraulic piston, and hydraulic pressure received from external hydraulic lines. The rail member and the upright head form the letter "L" from the side elevational view, or profile in one embodiment of the invention. The rail member includes a blade guide, illustrated as an inverted T-shaped grooved channel along its upper section. The upright head further has a slotted opening merging with the end of the grooved channel. By means of this grooved channel and slotted opening in the upright head, the cutting blade can be guided along the rail member, enter and pass through the rigid upright head. In the open retracted position, the hydraulic piston is fully retracted and therefore the cutting blade is also fully retracted. The opening between the cutting edge of the cutting blade and the upright head forms a mouth or closable jaw for inserting transversely a portion of the tail pipe or other section of a workpiece to be cut, or severed. The term "workpiece" is defined as the thing or article operated on, altered, changed, or reduced by the present invention. One purpose of this invention is to easily sever sections of a tail pipe on either side of a catalytic converter to quickly remove the catalytic converter from an automobile during the dismantling process of a scrapped automobile. After the catalytic converter is severed, then the precious metals and rare earth elements contained within the catalytic converter are removed and recycled.

The present invention can also be used to quickly cut away and remove a gasoline tank from an automobile, to cut away a steering wheel, or even to remove the trunk from an automobile.

The hydraulic pressure forces the cutting blade to quickly sever the metal or even steel tail pipe in the mouth of the tool without much effort. The rigid upright head acts as a brace against the workpiece and the approaching cutting blade, which together basically pinch, compress and cut the cross section of the tail pipe, or workpiece and easily cuts it into two sections.

The hydraulic pressure can be supplied from a portable power supply unit and hydraulic pump for use in field conditions. The power supply can be: an electric motor energized by 110 volt A.C. household current, or direct current; or a gasoline motor. There is usually an automobile type of battery which energizes an electrical motor which in turn rotates the hydraulic pump for providing the necessary hydraulic fluid under pressure to a reservoir tank and to the extensible and retractable hydraulic piston mounted at the rear of the frame member. There are typically two hydraulic lines interconnecting the hydraulic pump/reservoir and the hydraulic piston. There is also an electrical on-neutral-off position switch, which is commonly referred to as a "dead man's safety switch", or an open centered switch for activating or deactivating the hydraulic pump or reservoir, whether voluntarily or involuntarily. By controlling the "dead man's" switch, the cutting action and movement of the blade is also controlled.

There are other embodiments of the basic invention. One is the modified rigid upright head extending from the front end of the rail member. It is formed by a pair of ribs into the shape of the letter "C". This upright curved head and rail member combine together to form a cane shaped frame in profile from the side elevational view. This C-shaped, or claw-shaped head provides better grasping and containment of the section of the tall pipe, or workpiece when the V-shaped cutting blade is being forced by the shaft extending from the hydraulic piston to sever the section of the workpiece.

The cutting blade is normally a V-shaped, or an arrow shaped configuration in profile and the cutting edge has been sharpened and bevelled on both faces so that the cutting edge is also V-shaped in its transverse cross section. The cutting blade is attached to the shaft, or ram extending from the hydraulic piston and can be unscrewed and removed. It is secured to the shaft by fasteners such as allen head screws, or nuts and bolts. The cutting blade can be removed from the tool by means of removing the fasteners securing the cutting blade to the shaft of the hydraulic piston and then the cutting blade can be slid out along the grooved channel of the rail member and passed through the slotted opening in the upright rigid head of the frame. In this way a replacement cutting blade can quickly be installed while the other blade, which was previously removed, can be resharpened for later use. The grooved channel in the frame member can be an inverted T-shape in cross section. The base of the cutting blade has a flange which slideably engages with the grooved channel. The blade flange/rail member channel combination serves to align and guide the blade along its cutting path, and it also prevents the blade from disengaging from the rail member. As stated, the cutting blade is removable and interchangeable with other types of blades. Depending on the type of workpiece to be cut, the cutting edge of the blade can serrated, obliquely angled, bevelled on one face only, or convex shaped. In the second embodiment where the upright head forms a C-shape, the cutting edge of the blade is not bibeveledly sharpened on both sides of the face, or double cut. Rather, only one face is sharpened in a bevelled manner.

In combination with the first embodiment of the cutting tool, there is an adjunct tool, termed a clamping tool, which is an adjustable locking pair of pliers having an upper expandable jaw and a lower expandable jaw which in turn have a pair of opposed semicircular expandable clamps facing each other. The adjustable locking pliers are to be used to minimize any deformation in the circular cross section of the tail pipe, or workpiece when it is severed. Without this adjustable clamp, the force of the cutting edge of the cutting blade will depress and deform the wall of the tail pipe slightly before the tip of the cutting blade begins to penetrate and sever the section of tail pipe. The adjustable locking pliers are initially positioned adjacent to where the workpiece such as a section of tail pipe is to be severed. Then the adjustable locking pliers are adjusted and the pliers are locked into position causing the two rounded clamps to basically surround the circumference of the wall of the exhaust pipe and maintaining it in a circular form. When the cutting tool is placed adjacent to the clamped on locking pliers, any deformation of the circularity of the severed end of the tail pipe is thereby minimized. This is important when the tool is used to remove only a portion of the exhaust system of an automobile and to replace it with a new exhaust system, as for example in a muffler shop. By maintaining the circularity of the severed end of the remaining exhaust system, the circular end piece of the replacement section of the muffler section matches up quite well with the cut end, and it can be welded into place without having to reform the severed end to make it round again.

There is also another adjunct tool, termed a spreader adaptor, which can be bolted to, or otherwise demountably attached to any of the embodiments. It functions as a prying tool to pry apart tangled pieces of metal, which is usually the situation encountered when dismantling a wrecked automobile, which has previously been in an accident The tangled and twisted metal caused by the accident has to be separated sufficiently and pieces of the automobile have to be severed and cut away when the automobile body itself is being parted out and broken down for scrap metal and the like. As previously stated, the cutting tool itself, without the spreader attachment, is used to shear door pillars, to remove most roofs, trunks hoods, transmission cross members, drive shafts, rear ends, and hundreds of miscellaneous parts fast and simple.

There is a bolt pattern previously drilled in the front end of the rail member, in the upper end of the rigid head, and in the cutting blade for attaching a pair of spreader bars and support linkage. The pair of spreader bars is connected to the cutting blade by a forked link, which in turn is connected to the cutting blade by a push rod. When this spreader adaptor is interconnected to the cutting blade through the linkage, then when the hydraulic piston is actuated, the closed pair of spreader bars will open and spread apart any two pieces of metal in between which the closed pair of spreader bars has been positioned. This adaptor can also be used in the emergency situation where an accident victim is caught inside a twisted and torn automobile. The metal has to be cut or otherwise bent in order to open up the door or the like to extricate the accident victim. In this situation, the cutting tool can be used without the spreader to cut away portions of the door, roof, or pillar, and then can be used with the spreader attached to spread apart some of the twisted portions of metal. The cutting tool and the spreader adaptor would normally be sufficient equipment to provide access to remove the accident victim from the damaged vehicle.

The spreader adaptor can also be used as a jack to raise the vehicle, or any heavy object by placing the closed spreader between a portion of the automobile undercarriage and a support block resting on the ground. The spreader bars will spread apart and raise the vehicle in response to the hydraulic piston and cutting blade forcing the push rod to expand the fork link and spread apart the pair of spreader bars.

There is a third embodiment of the cutting tool. In the third embodiment wherein: the C-shaped upright rigid head is more pronounced and curved rearwards than in the second embodiment; adjacent to the rigid head is a concave recess cut away in the top of the rail member; and the arrow shaped cutting blade is modified to have a circular concave cutting edge sharpened on one face only. As options, there are a pair of handles attached to the hydraulic piston housing to give the operator of the tool greater maneuverability when using this embodiment. The frame retains generally the basic configuration, but the upright rigid head section has a pronounced C-shaped profile. In this embodiment, the concave blade, the C-shaped rigid head, and the recess in the frame member combine to create a circular trap so that the workpiece can be sliced, or severed quite cleanly. This embodiment functions best when the workpiece is made from a relatively soft material.

There is a fourth embodiment of the cutting tool and is most similar to the third embodiment. As in the third embodiment, there is the C-shaped rigid upright head, the concave recess in the frame member, and the cutting blade having a concave cutting edge. However, the cutting blade in the fourth embodiment does not slide along the blade guide in the frame member. Rather, its base is pivotally attached to the frame member, and the back of the blade opposite the cutting edge is also pivotally attached to the moveable hydraulic shaft. The cutting blade severs the workpiece by pivotally moving down on and severing the workpiece.

DETAILED DESCRIPTIONS OF THE EMBODIMENTS

Figure 1:
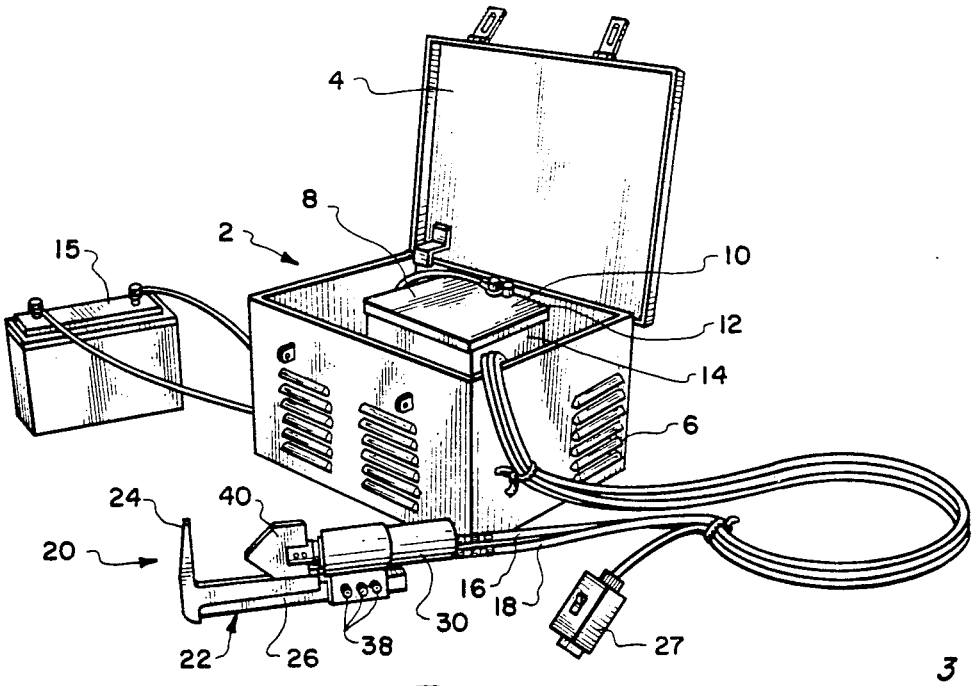
FIG. 1 discloses the self-contained portable version of the invention wherein there is a storage box having a battery, an electric motor, a hydraulic pump/reservoir, hydraulic hoses leading to the cutting tool, and an operator's control switch.

Referring now to FIG. 1 there is disclosed the fully self contained portable version of the invention which can be used under field conditions, for example at an automobile dismantling yard or at the scene of an accident. There is illustrated the storage box 2 having a lockable hinged lid 4 and having louvres 6 on the sides of the storage box to allow for air ventilation. Inside the storage box is a compartment 8 containing an electric motor 10 that drives a hydraulic pump 12. Neither one is visible in FIG. 1. There can be an optional hydraulic reservoir integrated with the pump and motor to act as a circulating coolant for the equipment in the compartment. In operation, the hydraulic pump is rotated at a given constant speed by the drive motor. The hydraulic pump provides hydraulic fluid at a preset constant pressure to a valve 14 (not shown) which can divert the hydraulic fluid to the cutter lines, or the valve can recirculate hydraulic fluid back to the pump. The diverter valve 14 is controlled by the operator actuating the remote control switch 27. Positioned outside the box for clarity purposes, is an automobile type of battery is showing the terminals and cables going to the DC electric motor inside the compartment 8. Exiting from the hydraulic pump, or diverter valve, are a hydraulic line 16 for retracting the shaft and attached blade, and a hydraulic line 18 for extending the shaft and attached blade. Both are connected to the cutting tool 20. An operator's control switch 27 is also wired into the compartment 8. The control switch can be used to either engage and disengage the drive motor to the hydraulic pump 12, or to control the flow of hydraulic fluid to the cutter 20 by controlling the diverter valve. The diverter valve can also be controlled by manual means when the invention is used underwater. Also in FIG. 1, the left side profile of the basic cutting tool 20 is shown.

There is shown a horizontal frame member means illustrated as a main frame 22 including a rigid head means illustrated as a front upright rigid head 24 and a horizontal rail member 26, which generally are described as forming an L-shape in profile. There is also an hydraulic cylinder means for moving the cutting blade illustrated as a piston located inside of the housing 30 which is mounted towards the back of the horizontal rail member by a mounting means illustrated as a mounting bracket 36 and nuts and bolts 38. The shaft means is illustrated as a circular shaft 32 having a mounting means for mounting the cutting means to the shaft. The shaft 32 extends from the left side of the hydraulic piston housing 30, and faces towards the upright rigid head 24 as disclosed. The hydraulic piston has connections for connecting to at least one hydraulic line to power the tool to move the cutting blade to sever a workpiece placed in the cutting tool's jaws. The cutting means is illustrated as the cutting blade 40 and is shown as being V-shaped with a bibeveled cutting edge 42. At the base of the cutting blade is an inverted T-shaped flange 44 which cooperates along an open inverted T-shaped grooved channel 50 cut lengthwise in the rail member 26. This is generally described as the blade guide means formed by an open recess running the length of the rail member and the flange means at the base of the cutting means. This combination of the inverted T-shaped flange 44 and the inverted T-shaped grooved channel 50 prevents the cutting blade 40 from disengaging from its track when in operation.

The blade guide can be any type of a blade guide means for providing a guideway for the cutting blade. It could have many configurations in cross section. For example, key-hole shape; inverted V-shape; or cross shape. The corresponding flange means at the base of the cutting blade would then have a complementary matching configuration in cross section.

Figure 6:
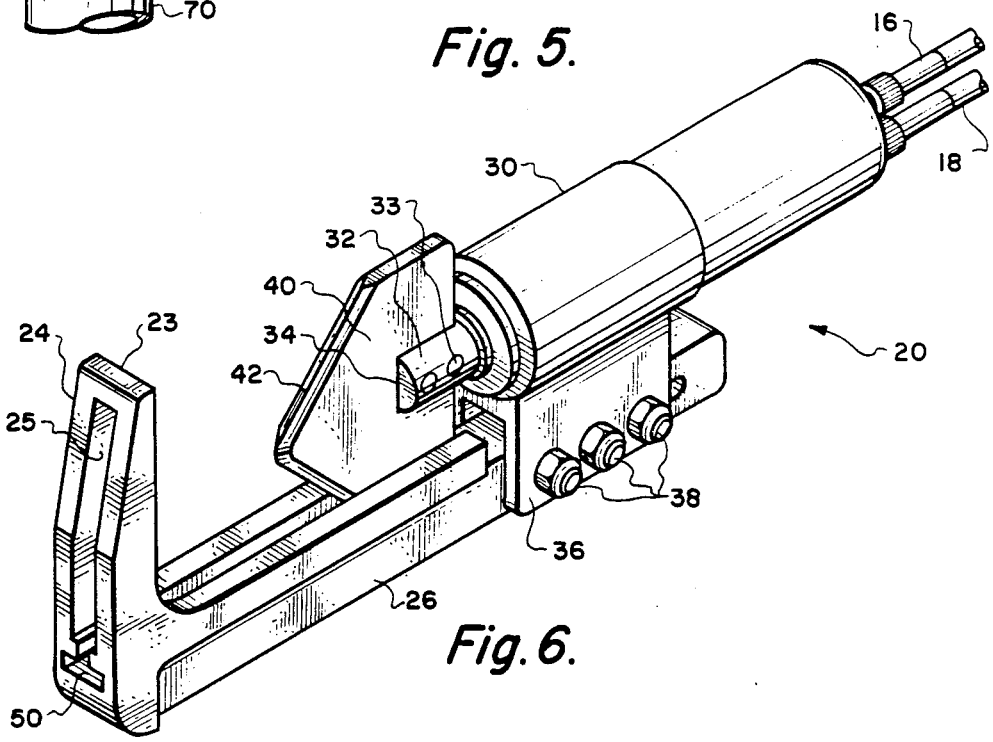
FIG. 6 is an isometric view of the first embodiment of the invention showing the cutting blade in its open position.

In FIGS. 1 and 6, the cutting blade is at its open at rest position. This tool is commonly used to sever transversely an exhaust pipe or tail pipe, remove a gasoline tank, cut away a steering wheel, or remove a trunk from an automobile or other vehicle. It is quite frequently used in salvage operations in an auto wrecking yard where a catalytic converter is to be removed and the rare earth elements in the catalytic converter are reclaimed. The tool can shear transmission cross members, drive shafts, rear ends, exhaust systems, most roofs, trunks, hoods and hundreds of miscellaneous parts fast and simple. The opening of the tool 20, that is, the gap formed between the V-shaped cutting blade 42, the upright rigid head 24, and the horizontal rail member 26 is transversely positioned around the tail pipe. The operator's control switch 27 is then actuated. The hydraulic fluid forces the hydraulic piston in the housing 30 to expand causing the hydraulic shaft 32 & head to extend, and the attached cutting blade 40 to move forward along its guide to engage and sever the piece of the tail pipe held in the opening. This operation is quite rapid and can be done in a matter seconds. The cutting speed of the blade can be modified by design, but normally travels at one inch per second. There is a slot means illustrated as a slotted opening 25 in the rigid upright head for allowing the cutting edge to enter and pass through as the work piece is being severed. This allows for a complete pass of the cutting blade through the section of the workpiece being severed.

After one section of the exhaust pipe has been severed, the operator reverses the control switch 27 to retract the cutting blade so that the cutter is again ready for use on the other side of the catalytic converter. The operation is performed again on the other section of exhaust pipe and the catalytic converter drops out of place. In other applications, the hydraulic piston 30 could be coupled to hydraulic pressure lines; for example, as found in a muffler shop. In this application the invention would normally be used to discard or sever pieces of exhaust pipes and tail pipes so that they can be removed and replaced with a new section of tail pipe and/or muffler. When the tail pipe is being severed on a car for a muffler repair, the remaining cut end section of the tail pipe left in tact on the automobile should be left as rounded as as possible so that the new replacement rounded section end of the replacement tail pipe can be easily matched up and welded to the stump left on the automobile.

Figure 2:
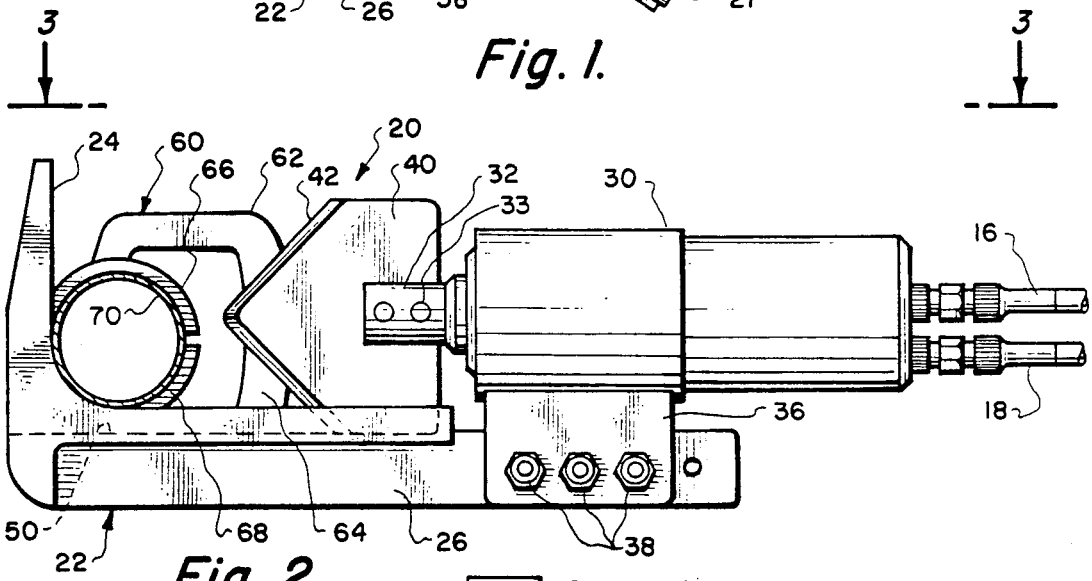
FIG. 2 shows a left side elevational view of the first embodiment of the invention with the cross sectional view of an exhaust pipe about to be severed along with the opposed expandable jaws and clamps of the clamping tool correctly positioned.

When severing and salvaging catalytic converters in an automobile dismantling yard, the deformation of cut ends of the exhaust pipes is not considered important. However, when the invention is used in a muffler shop, then this invention has an adjunct tool illustrated and described in FIGS. 2–5. The tool is termed a clamping tool 60. In FIG. 2 the portion visible is the upper 62 and lower 64 opposed expandable jaws of the adjustable pliers. There are a pair of opposed rounded clamps 66 and 68 attached to the open ends of the expandable jaws. The remainder of the clamping tool includes a pair of adjustable and locking pliers somewhat similar to the Vice-grip type of adjustable locking pliers/-clamps well known in the marketplace. There is a lever not shown which will lock and maintain these opposed rounded clamps 66 & 68 in a stationery position without having the operator manually pressing down on the pair of pliers to keep the clamps in position. The correct positioning of the locking clamping tool 60 is readily apparent in FIG. 3 and in FIG. 4. The clamps are placed adjacent to the area where the exhaust pipe is going to be cut or severed. When the cutting blade 40 severs the exhaust pipe 70, the clamping tool 60 tends to minimize or eliminate any deformation at the cut end of the remaining intact portion of the exhaust pipe. This is for the sake of eliminating the need for the mechanic to re-round or true out the open end of the intact cut end of the exhaust pipe. In this way the replacement section of the muffler and tail pipe can be repositioned on the automobile and the new section and the cut intact section can be positioned face to face and the mechanic can weld these two connections to form a continuous leak free conduit from the engine and out the tail pipe.

Figure 4:
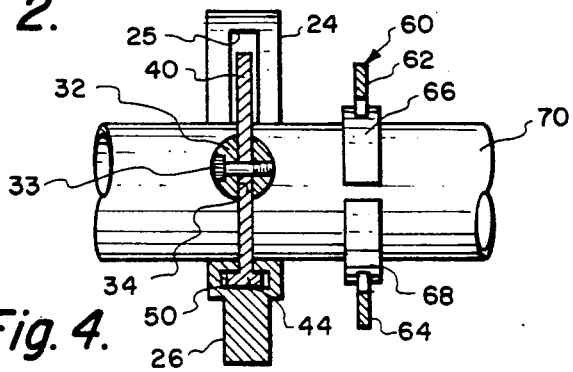
FIG. 4 is another view of the invention taken along the lines 4—4 of FIG. 3.

Referring now to FIG. 2 there is illustrated the left elevational view of the basic cutting invention 20 with the workpiece 70 in place and the clamping tool 60 also correctly positioned. The cutting blade 40 can be described as an arrow shaped flat blade having a V-shaped cutting edge 42. The cutting blade is connected to the hydraulic piston by means of a shaft and shaft head 32 which is mounted medially at the back area of the mainframe 22. The head of the shaft has a slot 34 cut in it so the medial back area of the cutting blade can be centered in it and fastened to the shaft. There are two allen head screws 33 for holding the cutting blade in position. The cutting blade can be removed from the head of the hydraulic piston shaft by the removal of the two screws. The base of the cutting blade is not shown in FIG. 2, but the cross section of it is discernible in FIG. 4 shown in cut away area cross sectional view of the cutting blade. There is shown the screws 33, portions of the rounded clamps 66 and 68 of the clamping tool 60, and the inverted T-shaped flange 44 at the base of the cutting blade 40. This T-shaped flange is complementary with and slides along an inverted T-shaped grooved channel 50 cut lengthwise in the horizontal rail member 26 forming the lower portion of the cutting tool. In this configuration, the cutting blade is forced forward when severing the transverse section of the exhaust pipe or workpiece 70. The grooved channel 50 guides the cutting blade along its predetermined cutting path.

The left end of the main frame 22 has an upright rigid head 24. This upright rigid head and the horizontal rail member 26 together form an L-shaped configuration in profile or silhouette. Also, as can be seen, the upright rigid head has a slot 25 so that the slot, which is slightly larger then the cross section of the blade 40, allows the cutting edge 42 and blade to pass into and through the upright rigid head 24. In this way the section of the tail pipe 70, which is placed in the gap between the head 24 and the cutting blade 42, and the cutting action of the blade cleanly slices or severs the exhaust pipe, because the entire cutting edge of the blade passes into and through the slot 25 of the upright rigid head 24.

Figure 3:
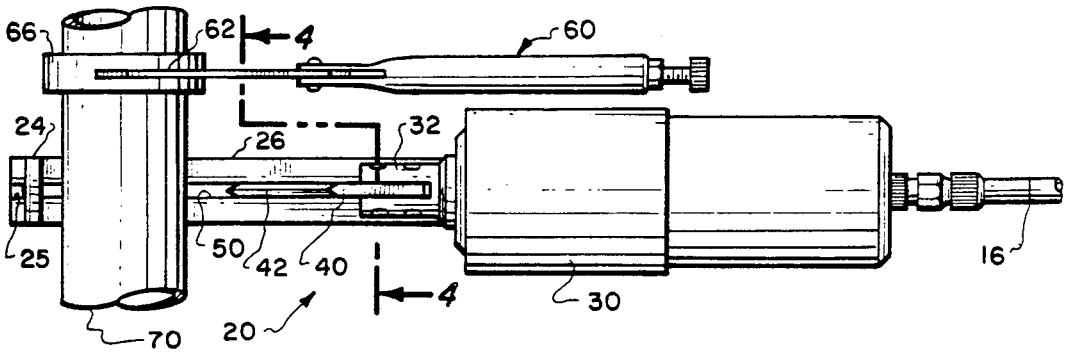
FIG. 3 is a top plan view showing the invention taken along the lines 3—3 of FIG. 2.
Figure 5:
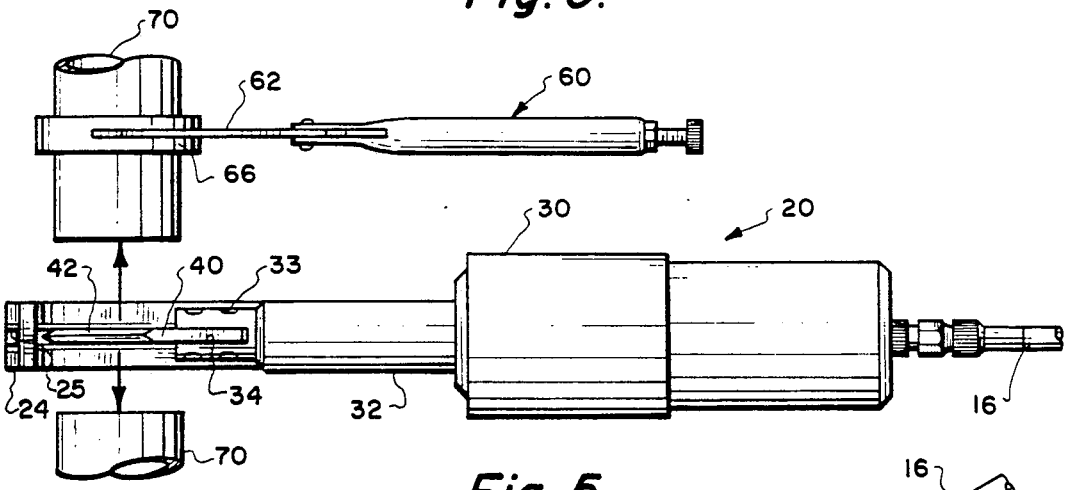
FIG. 5 is final sequential step of the cutting process shown in FIG. 3 wherein the cutting blade has severed the pipe and the exhaust pipe is separated.

The hydraulic piston is located inside of its housing 30 illustrated in FIGS. 2, 3, and 6. It is a fixed hydraulic piston, which is not visible in the drawings, and is connected to two hydraulic lines 16 and 18. The hydraulic piston and housing 30 are fixedly mounted towards the back or right end of the main frame by a mounting bracket 36, which is mounted to the frame by a series of three nuts and bolts 38 placed in a parallel relation.

When the operator energizes the remote control 27, or "dead man's" switch, the hydraulic fluid flows through the extension line 18 and into the hydraulic piston, which forces the hydraulic shaft 32 to extend outwardly away from the piston housing 30 causing the cutting blade 40 to travel along its guide way 50. The hydraulic piston and the hydraulic pressure is sufficient to easily sever a workpiece 70, or other parts to be severed without any difficulty. In fact, from the initial open travel position of the cutting blade until it severs the workpiece, the time extended is roughly 5 seconds to make a final cut.

Figures 7, 8:
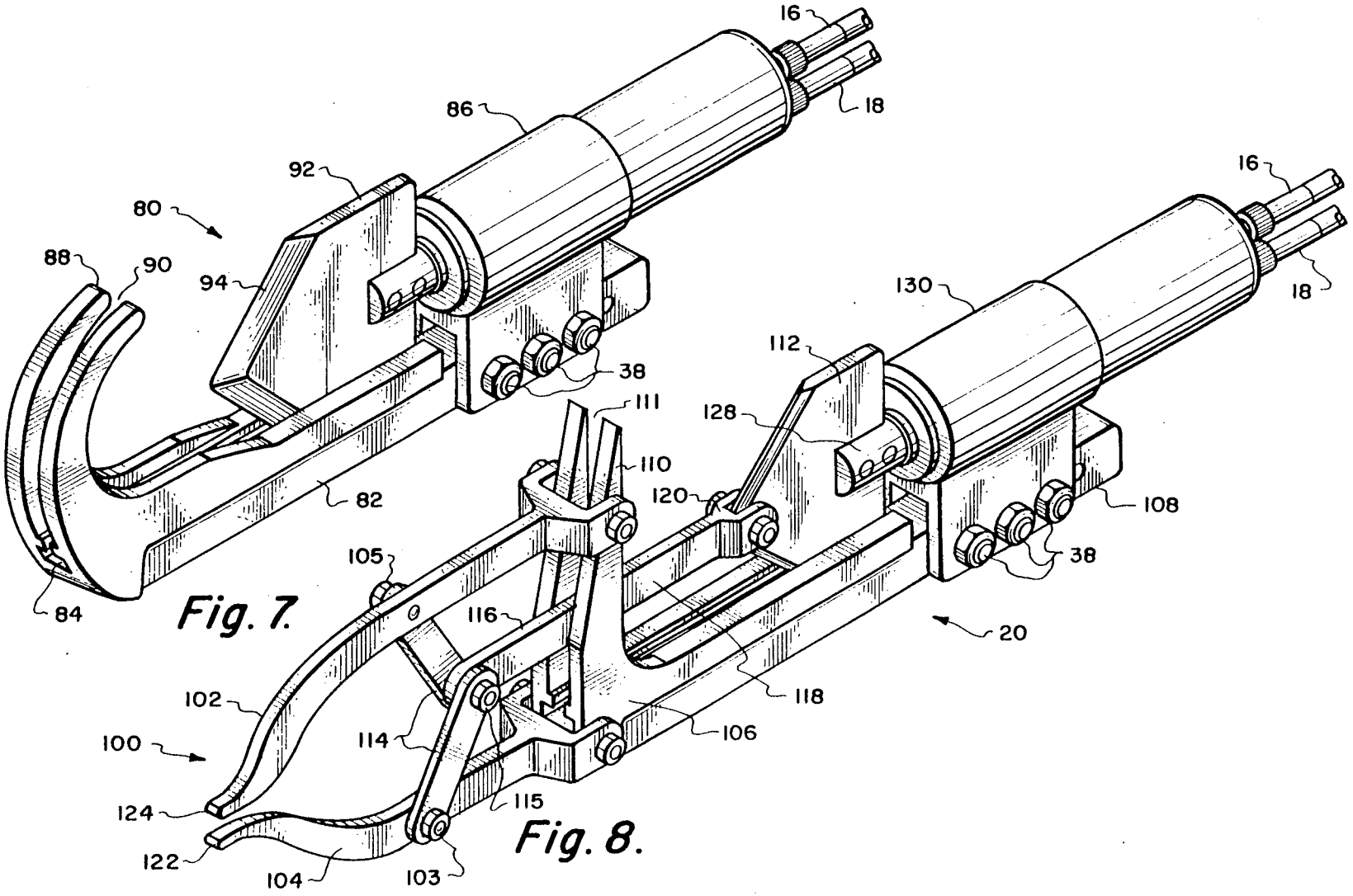
FIG. 7 illustrates the second embodiment of the invention shown in perspective view wherein the frame member and rigid head form a cane-shaped profile, and the cutting blade is sharpened on one face.
FIG. 8 shows an adjunct tool attachment. Spreader bars are bolted to the basic invention so that the cutting tool can function to pry open and spread apart twisted pieces of metal.

The basic invention can be modified as shown in the second embodiment 80 in FIG. 7. The rail member portion 82 of the main frame having the inverted T-shaped grooved channel 84 along with the mounted hydraulic piston and housing 86 are still present. However the upright rigid head means has been modified and is illustrated as a C-shaped form 88. The horizontal rail member 82 and upright fixed head 88 form the main frame means which resembles the shape of a walking cane in profile or silhouette. In this embodiment, as illustrated, the slot 90 does not have a cross brace 23 as disclosed in FIG. 6 of the first embodiment. However, the cross brace could be added, if desired. Additionally the cutting blade means illustrated as the cutting blade 92, instead of having a bibeveled cutting surface, has a single beveled cutting surface 94. The blade 92 is still V-shaped in profile. In this embodiment of the basic cutting tool, the adjunct clamping tool 60 is normally not required, because of the severing action of this single beveled cutting surface cooperating with this hook shaped, or C-shaped, upright rigid head 88. The cutting blade 92 tends to give a cleaner and less deformed transverse cut using this embodiment.

FIG. 8 shows a bolt-on spreader adaptor 100 for demountable attachment to the first embodiment, or with slight modification, for use with any of the embodiments described in this specification. There is a pair of opposed identically shaped spreader pry bars 102 and 104. There is a bolt hole pattern previously drilled in the elbow 106 of the main frame 108, in the upper end of the rail member 110 and in the cutting blade 112, all for the purpose of pivotally attaching the adaptor 100 to the cutting tool. The lower spreader bar 104 is bolted to, or otherwise pivotally attached at the elbow 106 of the L-shaped main frame 108. The second spreader bar 102 is positioned above the first spreader bar 104. It is bolted to, or otherwise pivotally attached to the upright rigid head 110. Each one of the pair of spreader bars is pivotally connected by pivotal connections 103 and 105 to a pivoted fork link 114, which in turn has a pivot connection 115 to one end 116 of a push rod 118. The push rod 118 in turn has its other end 120 bolted to, or otherwise pivotally connected to the cutting blade. In the normal configuration, the push rod is bolted to the tip of the cutting blade, and is positioned in the slot of the rigid upright head. The pivot connections 103 and 105 at the ends of the fork links 114, and the pivot connection 116 connecting the fork links to the push rod can be held together with rivets. In this configuration, the spreader adaptor unit 100 can be easily bolted to the basic cutting tool by slipping the push rod 118 between the slotted opening 111 of the head 110, and attaching the bars and the push rod with nuts and bolts at the holes drilled in the frame and the cutting blade. There is sufficient clearance between the walls of the slotted opening and the push rod to allow the push rod to reciprocate in the slotted opening 111. When this spreader adaptor is interconnected to the cutting blade through the linkage, then when the the hydraulic piston in the housing 130 is actuated from its maximum open at-rest position, the closed pair of spreader bars will open like a pair of scissors and spread apart any two pieces of metal in between which the tips of the closed pair of spreader bars has been wedged into or otherwise positioned between. The spreader bars 102 and 104 can also be used in the open position to compress a section of metal placed between the open tips 122 and 124 of the spreader bars. This is accomplished by actuating the control switch 27 to retract the hydraulic shaft 128 when it and the attached cutting blade 112 are at their maximum extension.

Any of the embodiments and the attached spreader adaptor can function as hydraulic rescue equipment. The adaptor can be used in the emergency situation where an accident victim is trapped inside an automobile involved in an accident. The cutting tool can remove portions of the automobile, and the spreader adaptor can bend, compress, or spread apart interfering portions of the automobile in order to extricate the trapped victim, or to provide access for the paramedics to evaluate and provide emergency care to the victim. The closed tips 122 and 124 of the spreader bars can be wedged into the cracked opening of a door which has been jammed and will not open. The spreading apart action of the spreader will open the door, or rip it off its hinges if necessary.

Figure 9:
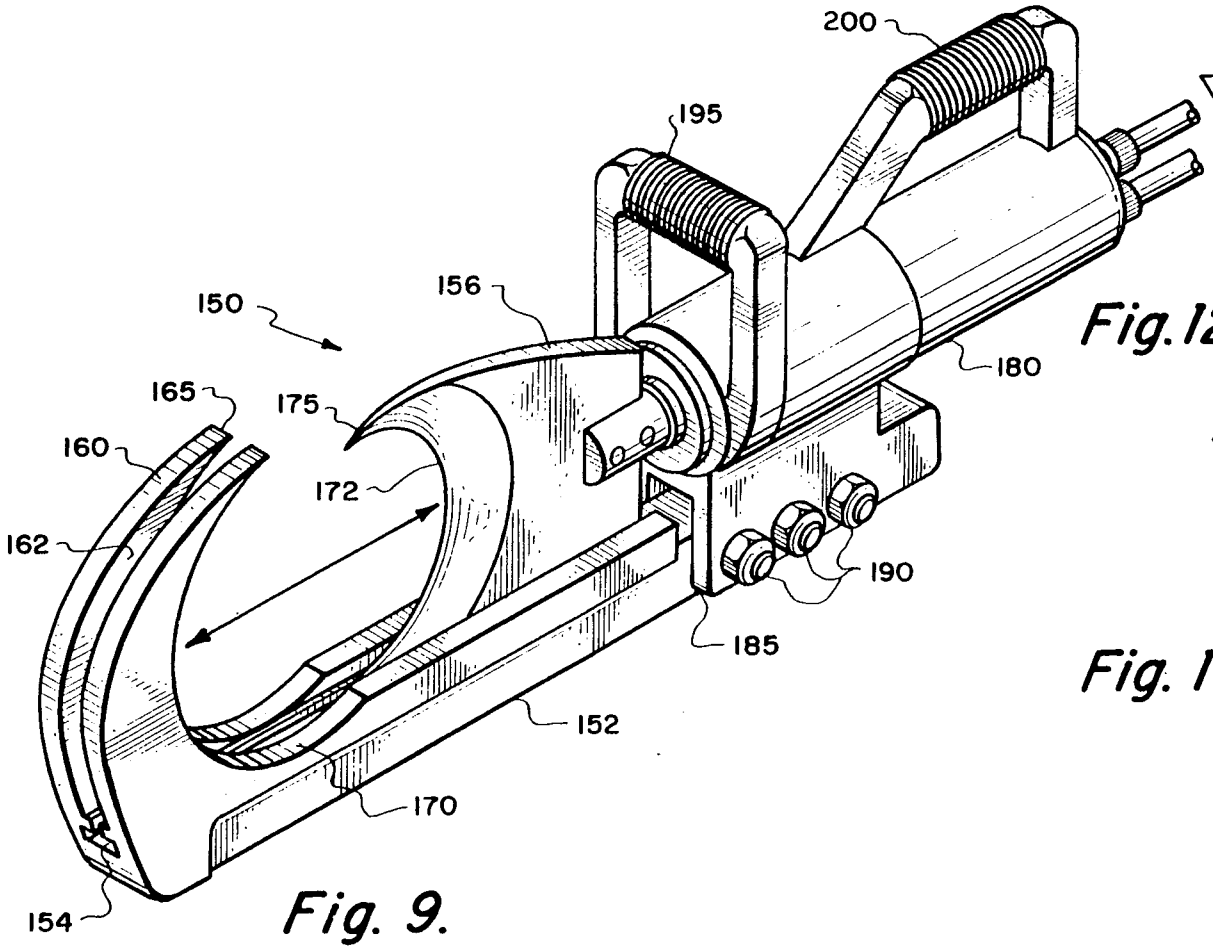
FIG. 9 illustrates a third embodiment of the invention wherein there are a pair of operator's handle grips to conveniently hold the invention. The cutting blade has a concave cutting surface, the rigid head has a pronounced C-shape or claw shape, and the frame member has a concave recess.

FIG. 9 illustrates a third embodiment 150 of the basic cutting tool as shown and described herein. There is the main frame means illustrated as a horizontal rail member 152 of the main frame having the inverted T-shaped grooved channel 154 machined lengthwise to form a guideway or track for the cutting blade 156. The upright rigid head means illustrated as an upright rigid head 160, a portion of the main frame, is in the shape of a letter "C" similar to that shown in FIG. 7 with the changes where the upper portion 165 of the "C" are more exaggerated and extend further to form a more prominent, almost pincerlike receptacle between the head 160 and blade 156. There is also a concave recess area 170 so that the rigid head will form a close complementary fit with the rounded surface of an exhaust pipe or workpiece 70. Likewise, the cutting means illustrated as a cutting blade 156 which travels along the guideway formed by the inverted T-shaped grooved channel 154, has a concave cutting surface 172 which has a pointed upper section 175 so that the opposed pincerlike rigid head 160 and the concave cutting surface 172 of the cutting blade 156 form a pincerlike type of opening so that the circumference of the exhaust pipe will fit quite closely when the cutting blade has been extended by the introduction of pressurized hydraulic fluid into the hydraulic piston in the housing 180. Additionally the cutting surface is beveled on one side only so that the flat side of the face of the cutting blade 156 matches very closely with the edge of the slotted opening 162 of the rigid head 160 to cause a very clean non-deformable slice when the cutting tool is used to sever a section of a workpiece. The hydraulic piston and housing are the same, the mounting bracket 185 mounting the hydraulic piston housing to the right end of the frame is the same, and the mounting brackets are held to the frame by a series of nuts and bolts 190. There are a transverse handle 195 and a longitudinal handle 200 extending from the housing 180 for grasping by the operator and to maneuver the tool.

Figures 10, 11:
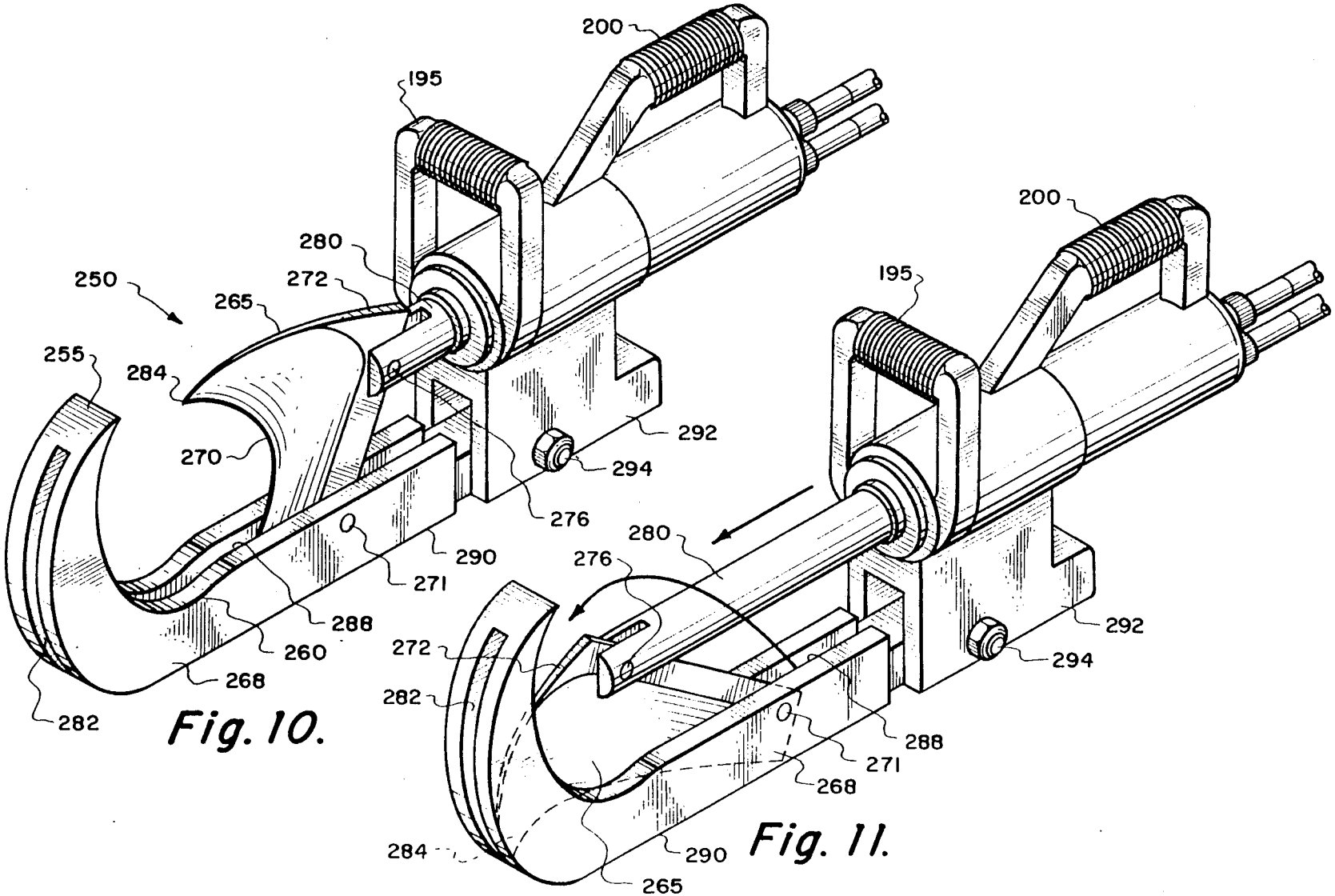
FIG. 10 illustrates a third alternative embodiment of the invention wherein the base, or lower point of the cutting blade is pivotally connected to the rail member, nd the rear of the blade is pivotally connected to the the hydraulic shaft.
FIG. 11 is a second sequence of FIG. 10 which illustrates the position of the pivotal cutting blade when the hydraulic shaft is at its maximum extension.

A fourth embodiment 250 of the cutting tool invention is illustrated in FIGS. 10 and FIG. 11. It is most similar to the third embodiment 150 illustrated in FIG. 9. As in the third embodiment, there is the C-shaped rigid upright head 255, the concave recess in the frame member 260, and the cutting blade 265 having a concave curved cutting edge 270. However, the cutting blade in the fourth embodiment does not slide back and forth in the blade guide in the frame member. Rather, its base 268 is pivotally attached with a pin 271 to the frame member 290, and the back 272 of the blade opposite the cutting edge is also pivotally attached with a pin 276 to the moveable hydraulic shaft 280. The blade does not have a flanged base. The cutting blade severs the workpiece by pivotally arcing down on and severing the workpiece. The pointed tip 284 of the blade cooperates with the slotted opening 282, or guide in the rigid upright head. The slot acts as a guide for the tip of the blade to keep the blade 265 properly aligned as it is cutting. The blade guide 288 in the frame member 290 does not have to be an inverted T-shaped grooved channel. The only requirement is a recess in the frame member to allow the base of the cutting blade to be pivotally attached to and rest in, and to allow the cutting edge to enter after it has finished cutting the workpiece. The slotted blade guide 282 in the rigid head and the recess in the frame member are optional features. The cutting blade could be designed and attached to the frame member by other means. The mounting bracket 292 is pivotally mounted on the frame 290 by a pivot pin means 294. As the shaft 280 begins to extend to sever the workpiece, the arcing movement of the cutting blade 265 forces the shaft 280 to tilt upwardly as it is extending until it reaches the apex of an arc as defined by the end of the pivot pin 276 as the shaft extends, and then the shaft 280 tilts back toward a horizontal position and possibly less than a horizontal position. There is a stop means (not shown}preventing or limiting the mounting bracket from tilting an further than required to allow the cutting blade to begin and finish a typical cutting operation.

The present invention can be used in general to dismantle and remove various components from automobile bodies. The open gap between the upright rigid head and the cutting blade is of sufficient dimensions to enclose a windshield pillar, or door pillar and the cutting action can sever either one of these to remove the roof of an automobile. It can also be used to sever tubing, hinges and the like to remove the trunk, doors, hood, gas tank, and steering wheel of an automobile while in the the process of being dismantled. It can also be used to cut away security bars over windows in case of a fire, and to dismantle and cut electric wires and cables.

Figure 12:
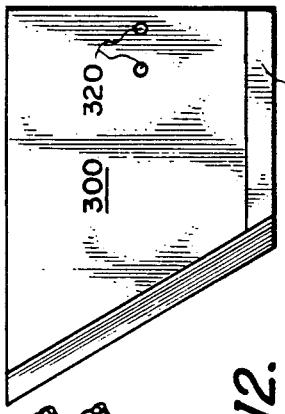
FIG. 12 illustrates a different style of an interchangeable replacement cutting blade having an obliquely angled cutting edge in profile.
Figure 13:
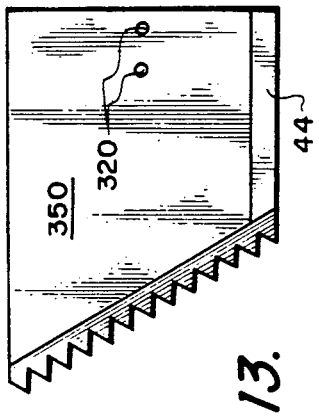
FIG. 13 illustrates another style of an interchangeable replacement cutting blade having a serrated obliquely angled cutting edge in profile.
Figure 14:
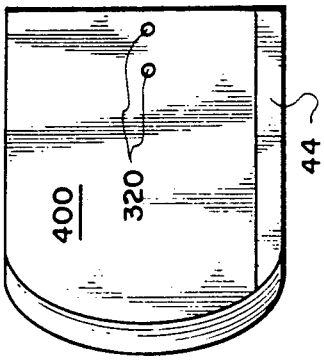
FIG. 14 illustrates yet another style of an interchangeable replacement cutting blade having a convex-shaped cutting edge in profile.

The various replaceable cutting blades illustrated in FIGS. 12–14 allow the invention to be used in an industrial setting to cut various types of material such as pipe, wire, wood, plastics, metal bars, tubing and the like. Blades 300, 350 and 400 each have a pair of mounting holes 320 for attached to the head of the shaft extending from the hydraulic piston. Additionally, each blade has a flange 44 for mating with the inverted T-shaped grooved channel in the horizontal frame member. Blade 300 has an obliquely angled cutting edge. Cutting blade 350 has an obliquely angled cutting edge with serrated teeth. Cutting blade 400 has an convex shaped cutting edge.

The cutting tool, when it has the pair of pry bars, or spreader adaptors illustrated in FIG. 8 attached to the upright rigid head can also be used in an emergency situation, for example at the scene of an accident of an automobile, airplane, or other type of vehicle. Quite frequently the victim of an automobile accident is caught inside the damaged automobile and cannot be extricted because the roof is crushed in or the steering wheel has been bent in its place or the doors are not openable, because they have been bent or otherwise crushed in some manner. In this situation the cutting tool could be used as a cutting instrument to remove the roof of a car by severing the windshield pillars and door pillars which hold the roof to the body of the automobile and thereby allowing the victim to be extricated from the automobile. Furthermore, the expandable spreader adaptor and tool could be used to spread apart or compress pieces of commingled metal to gain access to the accident victim. The expandable spreader adaptor could also be used to pry open a jammed door or even to separate it from its hinges. The spreader adaptor can also be used as an hydraulic jack positioned between the ground and frame of the automobile. As the adaptors spread apart in response to the hydraulic shaft being extended, the section of the automobile undercarriage contacting the spreader is raised in the same fashion as a conventional jack would do.

The main safety advantage of the configuration of a movable cutting blade, the rigid upright head, and the horizontal rail member, is that the tool can cut a workpiece without having the operator having to hold the tool while it is cutting. The cutting operation can be done by remote control. The tool is initially hand held in position with one hand holding the tool, then the operator presses the hand held control switch with the other hand to extend the cutting blade sufficiently until the tool can be left in place without the assistance of the operator. This is so because the tip of the cutting blade in conjunction with the other previously mentioned elements will function as a jaw to bite and hold the tool around the workpiece. The operator then stands clear of the area, and presses the "dead man's" switch forcing the cutting blade to sever the workpiece. If a piece of material breaks and becomes a flying projectile, the operator is out of harms way, because he is remotely controlling the cutting operation from a safe distance. Additionally, there is a safety relief valve inside the hydraulic pump which limits the amount of hydraulic pressure to 3,000 p.s.i. Of course, various kinds of pressure relief valves could be installed having different maximum pressures as determined by the intended use for the tool and the size of the tool and hydraulic piston. The pressure relief valve prevents the tool from being used to sever a workpiece that cannot safely be cut with the tool. Once hydraulic pressure exceeds the limit of the pressure relief valve, the cutting blade stops moving forward and the hydraulic fluid is diverted back to the hydraulic pump.

The rigid head can also be utilized to function like the head of a claw hammer. The tool can be inverted from the positions shown in the drawings. The main frame can be swung down causing the end of the rigid head to be wedged into a tight area so that the gap of the tool has the workpiece in it and ready for the cutting operation. For example, it could be used to cut the metal straps holding a gas tank in place in an automobile. The head would wedge underneath the metal strap to push it away from the tank forcing the strap into the jaws of the cutting tool.

Another safety feature of the tool comes into play when the operator is working underneath an automobile chassis which has been raised or stacked high above ground level. Even after the cutting operation has been completed, the severed workpiece stays in the gap of the tool. This causes the tool to remain in place until the cutting blade is retracted by the operator. This prevents the cutting tool from falling to the ground as soon as the severing of the workpiece has been completed. The operator can hold on to the tool, and then retract the blade to release the tool from the workpiece by operating the control switch. A falling cutting tool could severely injure someone or damage the tool itself. The switch can be a center type of switch which requires the operator to hold the switch in the forward or reverse position. If he releases his hand from the switch, the cutting blade stops moving. This is another safety feature.

The control switch could also be positioned adjacent the tool and in line with the hydraulic lines. In this arrangement, the tool is held in one hand while the other hand actuates the switch to move the blade.

The basic invention could be modified to function like a press, punch or riveter. The upright rigid head could have attached to it, or die cast in an appropriate shape, a platform to hold the workpiece to be punched, riveted or pressed. The cutting blade could be replaced with an instrument to punch, rivet or press the workpiece placed in the jaw or opening of the tool. The hydraulic piston would extend and retract in the usual manner.

Obviously, many modifications and variations are possible in light of the above teachings. It is therefore to be understood that the full scope of the invention is not limited to the details disclosed herein and may be practiced otherwise than as specifically described.

What is claimed is:

1. A cutting tool comprising:

frame means having a front and a back;

an upright fixed member positioned at said front of said frame means;

housing means mounted toward the back of said frame means;

said frame means having a guideway means cut lengthwise for providing a guideway for a cutting blade to reciprocate back and forth therein;

hydraulically actuated piston means in said housing and having an extensible and retractable shaft facing said upright head;

said shaft having a blade mounting means;

cutting blade means attached to said blade mounting means on said extensible and retractable shaft extending from said hydraulic piston means for cutting a workpiece;

said cutting head being a flat blade formed in a arrow shaped profile and further having the cutting surfaces beveled on both sides of the faces;

slot means in said upright fixed member for allowing said cutting means to pass into and through said upright fixed member;

said cutting blade means having a flange means and being reciprocative along said guideway of said frame means under power from said hydraulic shaft means;

said flange means forms an inverted T-shape in cross section and said guideway means forms a complementary inverted T-shaped channel in cross section;

said hydraulic piston extensible in causing the extension and retraction of said shaft attached to such cutting blade for moving said cutting blade towards and into said upright frame for severing a transverse section of a piece of metal placed in said opening between said upright frame and said cutting blade for severing said piece of metal;

said cutting head being retractable to its at rest position for allowing for repeated action of cutting a piece of metal.

2. A cutting tool comprising:

an elongate horizontal frame having a front and a rear;

a C-shaped upright rigid head formed at said front of said horizontal frame;

a concave recess in the top of said horizontal frame and positioned inwardly from said C-shaped upright rigid frame;

said horizontal frame having a groove channel cut along its longitudinal length;

a hydraulic piston having an extensible and retractable shaft and attached at the rear of said horizontal frame by means of a mounting bracket;

a cutting head demountably attached to said shaft of said hydraulic piston;

said cutting blade having a arcuate concave shaped cutting edge;

said base of said cutting blade having a flange for complementary mating with said grooved channel in said horizontal frame for guiding and maintaining said cutting blade in proper alignment when it is in operation;

a vertically oriented slotted opening in said C-shaped rigid upright head for allowing said cutting blade to pass through while cutting a workpiece.

3. A cutting tool comprising:

horizontal frame member means and an upright rigid head means at one end for forming the main frame means for the tool;

said horizontal frame member and said upright rigid head form an L-shape in profile;

extensible and retractable hydraulic means attached to said frame member at the end opposite that of said upright rigid head means for providing power to the cutting tool;

cutting blade means attached to said hydraulic means for cutting a workpiece placed adjacent the cutting tool;

said cutting blade means includes an arrow-shaped flat blade having a bibeveled V-shaped cutting edge;

said horizontal frame means having a blade guide means longitudinally positioned for providing a guideway for said cutting blade means;

said cutting blade means having a cutting edge; slot means in said upright rigid head means for allowing said cutting blade means to enter;

said cutting blade means being moveable along said blade guide means while under power from said hydraulic means.

4. A cutting tool comprising:

horizontal frame member means and an upright rigid head means at one end for forming the main frame means for the tool;

said horizontal frame member and said upright rigid head form an L-shape in profile;

extensible and retractable hydraulic means attached to said frame member at the end opposite that of said upright rigid head means for providing power to the cutting tool;

cutting blade means attached to said hydraulic means for cutting a workpiece placed adjacent the cutting tool.

said horizontal frame means having a blade guide means longitudinally positioned for providing a guideway for said cutting blade means;

said cutting blade means having a cutting edge; slot means in said upright rigid head means for allowing said cutting blade means to enter;

said cutting blade means being moveable along said blade guide means while under power from said hydraulic means.

5. The cutting tool as recited in in claim 1 further comprising:

handle means for allowing the operator to hold and manipulate the cutting tool when in operation;

switch means to control the amount of hydraulic pressure and fluid being exerted on said hydraulic piston to control the forward and reverse movement of said cutting blade within said blade guide means.

6. The cutting tool as recited in in claim 2 further comprising:

handle means for allowing the operator to hold and manipulate the cutting tool when in operation;

switch means to control the amount of hydraulic pressure and fluid being exerted on said hydraulic piston to control the forward and reverse movement of said cutting blade within said blade guide means.

7. The cutting tool as recited in claim 3 wherein said hydraulic means includes:

a housing containing said hydraulic piston means;

mounting means for mounting said hydraulic piston housing on said frame member means;

a hydraulic piston positioned in said housing and having an extensible and retractable shaft;

said shaft having a cut groove means at the extensible end for mounting said cutting blade means to said shaft;

said piston housing having hydraulic pressure line means for supplying hydraulic pressure to said hydraulic piston means for causing said shaft to extend or retract under hydraulic pressure thereby moving said cutting blade forward and backward along said blade guide means;

said hydraulic pressure being sufficient to force said shaft to extend and allow said cutting blade means to sever a workpiece positioned between said rigid upright head and said cutting blade means.

8. The cutting tool as recited in in claim 3 further comprising:

handle means for allowing the operator to hold and manipulate the cutting tool when in operation;

switch means to control the amount of hydraulic pressure and fluid being exerted on said hydraulic piston to control the forward and reverse movement of said cutting blade within said blade guide means.

9. The cutting tool as recited in claim 4 wherein said hydraulic means includes:

a housing containing said hydraulic piston means;

mounting means for mounting said hydraulic piston housing on said frame member means;

a hydraulic piston positioned in said housing and having an extensible and retractable shaft;

said shaft having a cut groove means at the extensible end for mounting said cutting blade means to said shaft;

said piston housing having hydraulic pressure line means for supplying hydraulic pressure to said hydraulic piston means for causing said shaft to extend or retract under hydraulic pressure thereby moving said cutting blade forward and backward along said blade guide means;

said hydraulic pressure being sufficient to force said shaft to extend and allow said cutting blade means to sever a workpiece positioned between said rigid upright head and said cutting blade means.

10. The cutting tool as recited in in claim 4 further comprising:

handle means for allowing the operator to hold and manipulate the cutting tool when in operation;

switch means to control the amount of hydraulic pressure and fluid being exerted on said hydraulic piston to control the forward and reverse movement of said cutting blade within said blade guide means.

* * * * *